United States Patent [19]

Bohusch et al.

[11] Patent Number: 4,833,972

[45] Date of Patent: May 30, 1989

[54] WHEELED TABLE FLOOR LOCK APPARATUS

[75] Inventors: Glen D. Bohusch; George D. Hall, both of Erie; Edward M. Shostek, Fairview, all of Pa.

[73] Assignee: American Sterilizer Company, Erie, Pa.

[21] Appl. No.: 120,552

[22] Filed: Nov. 13, 1987

[51] Int. Cl.[4] ..... F15B 11/08

[52] U.S. Cl. ..... 91/465; 74/110; 74/520; 91/471; 269/322

[58] Field of Search ..... 269/322, 325, 323, 324, 269/326; 91/459, 465; 417/12; 74/520, 106, 110

[56] References Cited

U.S. PATENT DOCUMENTS

| | | | |
|---|---|---|---|
| 1,382,935 | 6/1921 | Schairer et al. | 91/465 X |
| 3,175,698 | 3/1965 | Dassler | 74/106 X |
| 3,241,828 | 3/1966 | Adolphson et al. | 269/325 |
| 3,260,164 | 7/1966 | Guentner et al. | 91/465 X |
| 4,273,513 | 6/1981 | Salina | 417/12 |
| 4,450,753 | 5/1984 | Basrai et al. | 91/465 X |

*Primary Examiner*—Edward K. Look
*Attorney, Agent, or Firm*—Kirkpatrick & Lockhart

[57] ABSTRACT

An apparatus for locking an wheeled table into a fixed location is disclosed. The base of the table is provided with both an electric motor coupled to a hydraulic pump and a manually operated hydraulic pump either of which may provide a source of pressurized hydraulic fluid. Extendable and retractable legs are provided on the base of the surgical table. Hydraulic cylinders disposed adjacent to each of the legs are provided with upper link members pivotally attached to the table's base and lower link members which are pivotally attached to the deployable legs. When pressurized hydraulic fluid is provided by the electrically driven or manually powered hydraulic pumps, the hydraulic cylinders disposed adjacent to the deployable legs are extended. Such extension is translated by means of the respective upper and lower link members into a vertical movement which lowers the supporting legs to fix the table in a specified location.

14 Claims, 3 Drawing Sheets

WHEELED TABLE FLOOR LOCK APPARATUS

BACKGROUND OF THE INVENTION

1. Field of the Invention

The present invention relates to wheeled carriers such as surgical tables, and, in particular, to an apparatus for supporting a wheeled carrier in a fixed location.

1. Description of the Invention Background

In various environments, it has proven necessary to support a wheeled carrier in a fixed location. For example, in connection with surgical tables it is necessary to allow a surgical table to be wheeled from a surgical patient preparation station to a surgical suite while supporting a surgical patient. However, while in the surgical suite, the surgical table must be maintained in a fixed location to allow the necessary surgery to be performed. Alternatively, if a wheeled surgical table is intended for use while supporting a patient within an image amplification apparatus, the table must be capable of being wheeled into position and locked in a fixed location relative to the image amplification apparatus.

Previously, wheeled tables were provided with a mechanical floor locking system. In such tables, casters were provided on the base of a surgical table. In order to fix such a table in a specific location, legs provided adjacent to each caster were lowered from the table base to support the table on the legs rather than on the casters. In order to deploy the supporting legs, a manually operated foot pedal was provided on the table base. The foot pedal was connected by an extended link to a cam member. The cam member was operatively connected to extended pivoted levers. In addition, the remote ends of the lever were pivotally connected to the supporting legs.

In the operation of such an apparatus, the activation of the foot pedal caused the cam member to be rotated. Such rotation caused the cam member to displace the inboard ends of the levers upwardly. The movement of the inboard ends of the levers caused the outboard ends of the levers to be lowered. This action caused the respective supporting legs to be lowered. The lowering of the legs allowed the table to be supported thereon in a fixed location rather than on the casters.

Applicants have discovered various problems with the prior mechanical cam/lever arrangement. First, it will be appreciated that the table weight to be lifted by the legs was significant; many such tables may weigh in excess of 800 pounds in addition to the weight of the patient. As such, the force required to lift the table by means of the legs in a single movement has proven excessive for hospital personnel. Further, the force required to raise the table yet further preliminary to the lowering of the table may also be unreasonably high. As such, means for raising a surgical table onto supporting legs which requires, at most, only a reasonable manual force is needed by the industry.

The functional requirements of such tables pose serious design problems which must be overcome in designing an alternative floor lock system. For example, the frequent use of such tables in connection with image amplification equipment requires that the means for deploying the supporting legs be compact in configuration. Meanwhile, as the tables must be completely portable, such as being capable of crossing elevator thresholds, the floor lock system must be retractable to a considerable degree. Accordingly, significant design constraints are imposed on surgical table floor lock systems.

The subject invention is directed toward an improved surgical table floor lock apparatus which overcomes, among others, the above-discussed problems and provides a table support system which is effective to support the table in a fixed location while requiring, at most, a minimum amount of manual exertion.

SUMMARY OF THE INVENTION

In accordance with the present invention, there is provided apparatus for supporting a wheeled table on deployable legs. The base member of the table is provided with a plurality of wheeled casters. Disposed adjacent to each of the wheeled casters is a supporting leg which may be lowered into ground engagement.

The means for lowering the respective legs is hydraulically powered. Such hydraulic power may be provided by means of an electric motor which drives a hydraulic pump. Alternatively, hydraulic pressure may be provided by a foot pedal which may be manually actuated. The actuation of the foot pedal causes a manual hydraulic pump cylinder to be displaced thereby creating hydraulic pressure. In either event, the hydraulic pressure is provided to hydraulic cylinders disposed adjacent to the floor lock legs. In particular, a central unlock control valve is connected to the rod ends of each hydraulic cylinder while a central control valve is in communication with the barrel ends of the hydraulic cylinders.

The rods of the hydraulic cylinders are each connected to corresponding link assemblies. The link assemblies each comprise an upper link which is also pivotally attached to the table base and a lower link which is also pivotally attached to the upper portion of each supporting leg. As such, when the rods of the hydraulic cylinders are extended by the application of hydraulic pressure to the barrel ends of the hydraulic cylinders, the central pivot of each of the linkage assemblies is caused to pass over its center. This action causes the respective supporting legs to be lowered which causes the entire surgical table to be raised off the casters and thereby fixed in a specified location. Because the links are passed over center, no hydraulic pressure is required to maintain the legs in a locked condition. In order to raise the legs, the rods of the hydraulic cylinders are retracted, the links are pivoted and the legs are raised.

Accordingly, the present invention provides solutions to the aforementioned problems present in connection with wheeled tables. As this invention provides an effective means of deploying supporting legs, which means may be manually actuated and yet does not require hydraulic pressure to maintain the table in a locked condition, the problems caused by prior art floor lock systems are alleviated. In addition, as the present invention provides a compact hydraulic/mechanical system, the design requirements relating to the available space and the minimization of manual effort are solved.

These and other details, objects and advantages of the present invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENT

Figure 1:
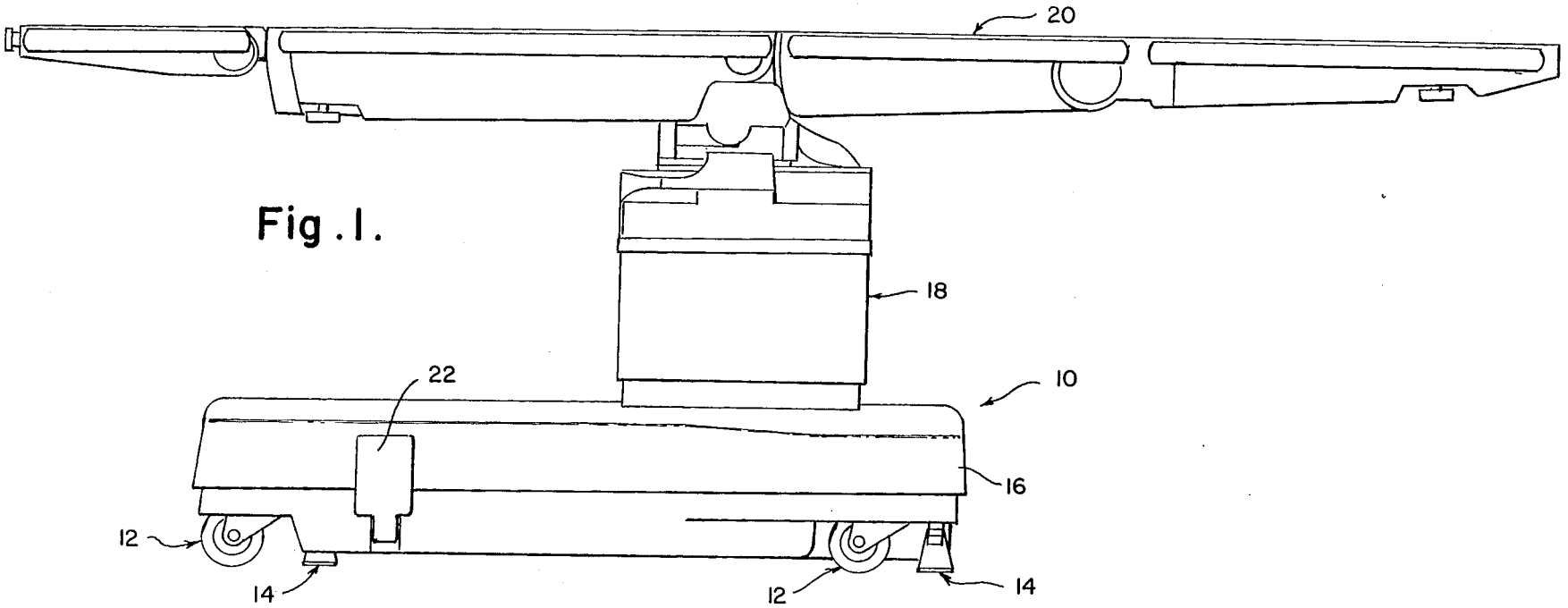
FIG. 1 is a side elevation view of a surgical table provided with the floor lock system according to the present invention.

Referring now to the drawings wherein the showings are for purposes of illustrating the present preferred embodiment of the invention only and not for purposes of limiting same, the Figures show a surgical table 10 which is provided with wheeled casters, generally shown as 12, and deployable supporting legs, generally shown as 14.

More particularly, and with reference to FIG. 1, the surgical table 10 includes a base portion 16 from which the casters 12 and the supporting legs 14 depend. Surgical table 10 includes a column portion, generally designated as 18, which, in turn, supports the patient supporting assembly, generally 20. FIG. 1 also shows a foot pedal 22 which is connected to base assembly 16 and which may be folded into the retracted position shown therein.

The base member of the surgical table 10 includes a base frame member 24. Frame member 24 supports the casters 12, supporting legs 14 and all other components of the surgical table 10. Pivotally attached to frame member 24 are the casters 12 which each include a bracket member 26 and rotatable wheels 28.

As noted above, supporting legs 14 may be lowered from frame member 24 in order to support surgical table 10 thereon. In accordance with the present invention, two rear supporting leg mechanisms 30 are attached to frame member 24 adjacent the casters 12 disposed on the widened foot end of surgical table 10. In order to support the head end of surgical table 10, a single supporting leg mechanism 52 is employed.

Figure 3:
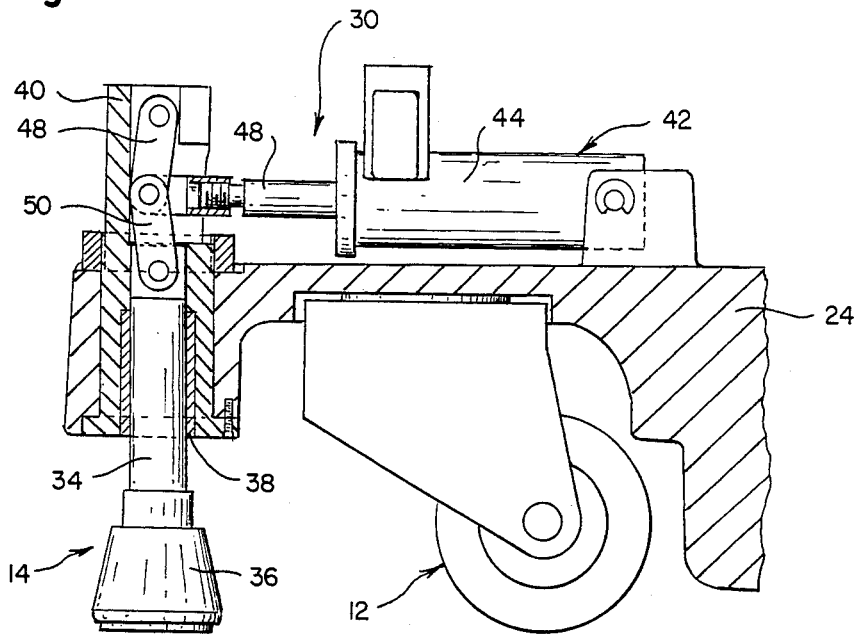
FIG. 3 is an end elevation sectional view taken along lines III—III in FIG. 2.

The foot end of table 10 may be supported by rear supporting leg mechanisms 30. The rear supporting leg mechanisms 30 disposed at the foot end of surgical table 10 are identical and reference will now be made to FIG. 3 which illustrates their structure. The rear supporting leg mechanisms 30 are each provided with a longitudinal leg member 34 which includes a widened base portion 36. Rear leg members 34 are each supported by frame member 24 for vertical movement within a corresponding surrounding bushing 38 which is retained by a corresponding collar 40 attached to frame member 24. In order that rear leg members 34 may be raised and lowered, a corresponding pair of rear hydraulic cylinders 42 is provided. Each rear hydraulic cylinder 42 includes a barrel portion 44 which is pivotally attached to frame member 24. A rod member 46 extends from each of the rear hydraulic cylinders 42. The outboard ends of rod members 46 are each pivotally connected to a corresponding first upper link 48 which is, in turn, pivotally attached to the corresponding collar 40. The outboard ends of rod members 46 are each also pivotally attached to a corresponding lower link 50. The lower ends of lower links 50 are pivotally attached to the upper ends of the corresponding rear leg members 34. As such, when a rear rod member 46 is extended by the application of hydraulic fluid under pressure to the barrel 44 of its rear hydraulic cylinder 42, the horizontal movement thereof is translated into a vertical movement which is applied by upper link 48 and lower link 50 to its leg member 34. Therefore, rear leg members 34 are lowered relative to frame member 24 in order to lift surgical table 10 from the wheels 28 of rear casters 12 in order to support surgical table 10 on the bases 36 of the rear supporting legs 30. It will be appreciated that, by virtue of the present system, the hydraulic pressure is translated by means of rear hydraulic cylinders 42 to a horizontal linear movement which is, in turn, translated by means of upper links 48 and lower links 50 to a vertical motion to deploy the rear supporting leg members 34. In addition, when the upper links 48 and lower links 50 are moved beyond their vertical positions over center, the rear supporting legs 34 are mechanically locked into their lowered positions. However, when hydraulic pressure is applied to the rod ends of each rear hydraulic cylinder 42, the rod members 46 pivot upper links 50 and lower links 48 thereby causing the retraction of rear leg members 34.

Figure 4:
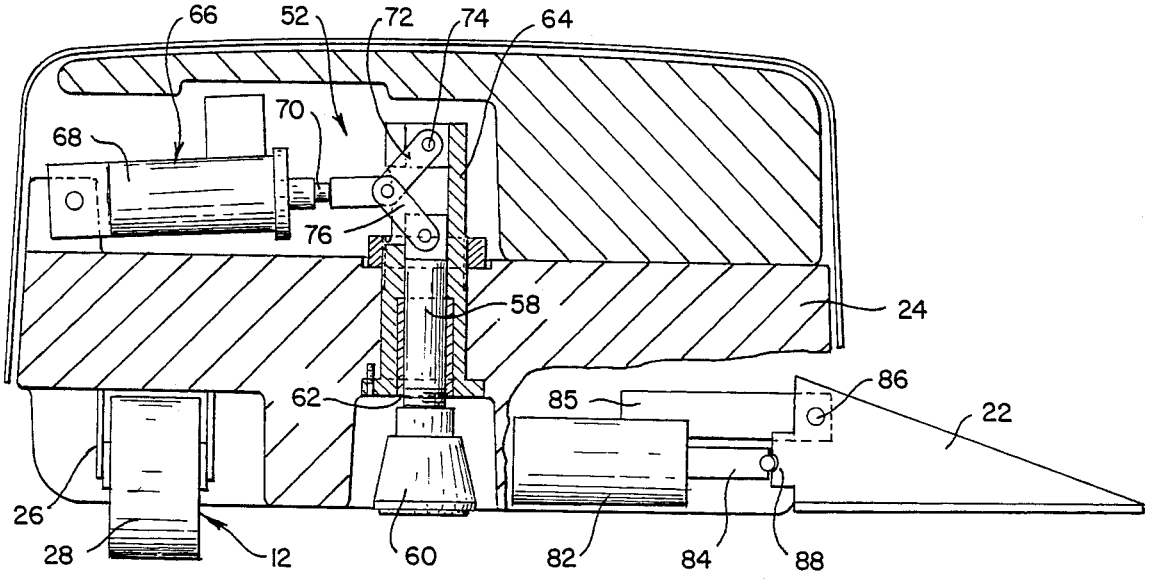
FIG. 4 is an end elevation sectional view taken along lines IV—IV in FIG. 2.

The structure of the front floor lock mechanism 52 is shown in FIG. 4. In particular, front floor lock mechanism 52 includes a front leg member 58 which is provided with a front base portion 60. Front leg member 58 is surrounded by a front bushing 62 which is retained within a front supporting collar 64 which, in turn, is secured to base frame member 24. A front hydraulic cylinder 66 includes a barrel portion 68 which is pivotally attached to frame member 24 and an extended rod portion 70. The end of rod 70 is pivotally attached to dual front upper links 72 which are also pivotally attached to a pin 74 which is attached to front collar 64. In addition, the end of rod 70 is pivotally attached to a front lower link 76. The other end of front lower link 76 is pivotally attached to front leg member 58. As such, when the rod 70 of front hydraulic cylinder 76 is extended, its horizontal movement is translated by front upper link 72 and front lower link 76 into a vertical movement to thereby lower front leg member 58 in order that its base portion 60 may engage the floor surface. Such action causes the front of surgical table 10 to be lifted from the front casters 12.

Figure 2:
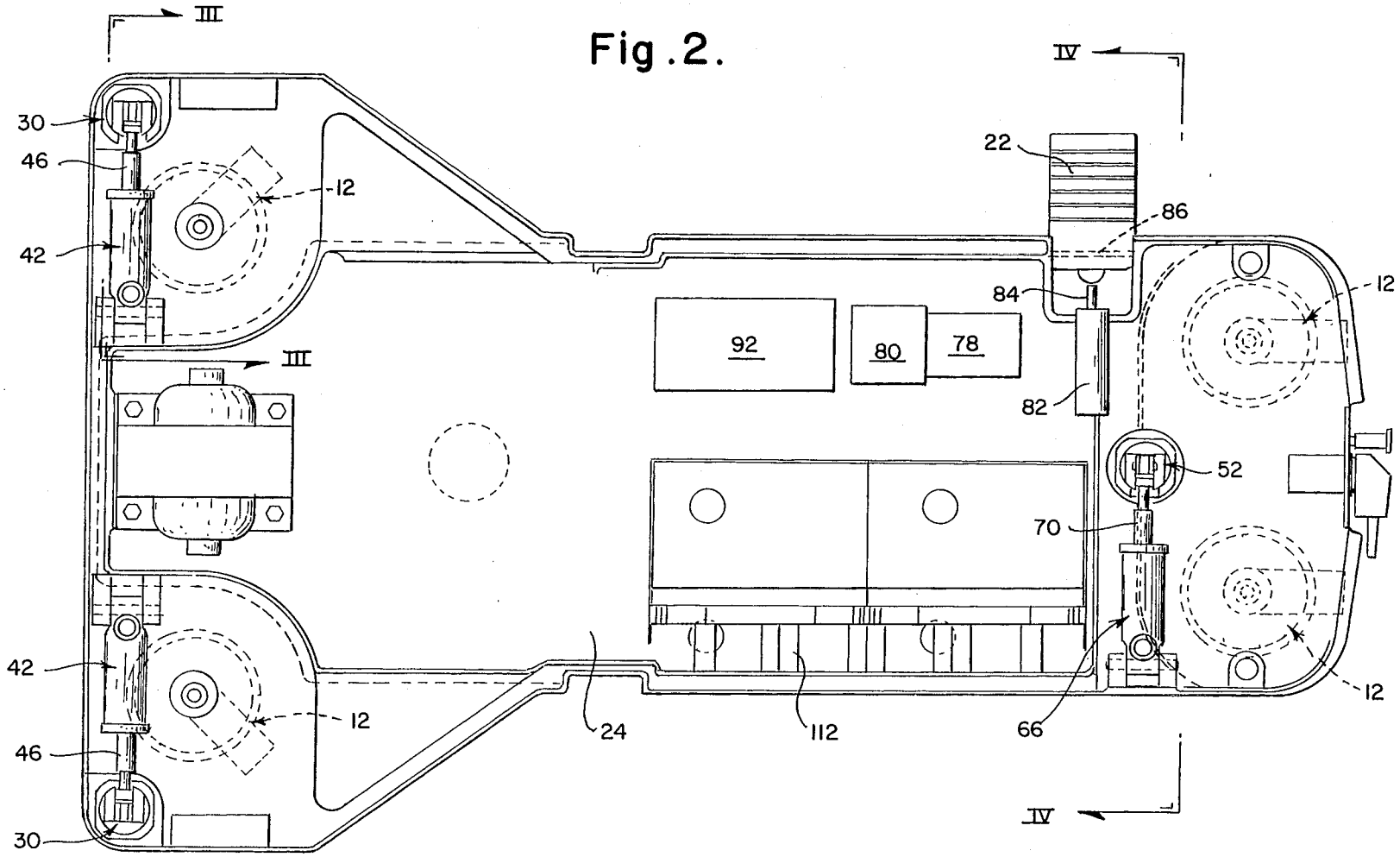
FIG. 2 is a plan view of the base portion of the table.

Frame member 24 also supports an electrically powered hydraulic motor 78 which drives a hydraulic pump 80. Hydraulic pump 80 provides hydraulic fluid under pressure for use in actuating rear floor lock mechanisms 30 and front floor lock mechanism 52. For use in lieu of electric motor 78 and pump 80 in lowering legs 14, a manually actuated hydraulic pump 82 is supported on frame member 24 and includes a spring-biased rod 84. Manual pump 82 also supports the foot pedal 22 by means of bracket 85 having a supporting pin 86. Foot pedal 22 is pivotally attached by means of pin 86 to manual pump 82 such that foot pedal 22 may be moved between the retracted position shown in FIG. 1 and the lowered position shown in FIG. 2. The actuation of rod 84 by the manual pivoting of foot pedal 22 about pin 86 by the foot of an operator provides the pumping action for manual pump 82 in order that an output of pressurized hydraulic fluid is provided thereby. In particular, manual hydraulic pump 82 is actuated by the engagement of an activating member 88 on foot pedal 22 with the end of rod 84. In operation, the engagement of activating member 88 with the end of rod 84 causes manual pump 82 to pressurize the fluid therein; the rod 84 is spring returned fon continued operation.

Figure 5:
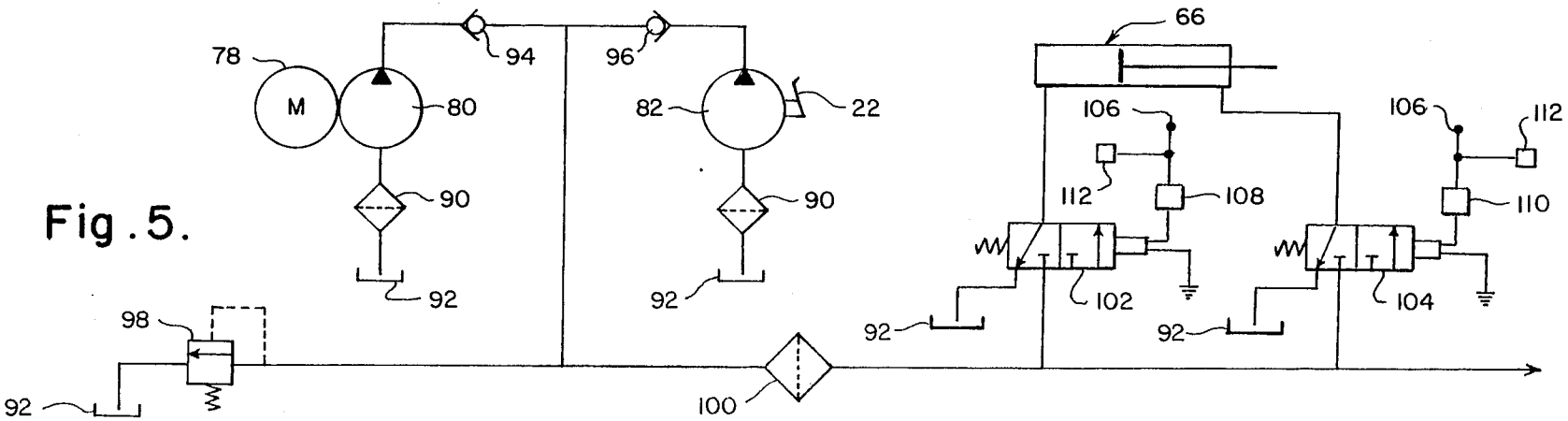
FIG. 5 is a schematic representation of the hydraulic components of the present invention.

The hydraulic circuitry employed to accomplish the functions described herein is depicted in FIG. 5. The input to powered hydraulic pump 80 and manual hydraulic pump 82 is provided through a common strainer 90 from a reservoir 92. The output of motor driven hydraulic pump 80 passes through a first check valve 94 and is joined with the output of the manual hydraulic pump 82 which passes through a second check valve 96. The pressurized hydraulic fluid may then be passed through a pressure relief valve 98 to the reservoir 92 if excessive hydraulic pressure is developed. Preferably, the hydraulic fluid passes through a filter 100 to the controlling mechanism for each of the rear floor lock cylinders 42 and the front hydraulic cylinder 66. The pressurized hydraulic fluid from pump 80 or from manual pump 82 is provided to each of the rear and front hydraulic cylinders 42 and 66, respectively, under the control of either a central electric solenoid actuated lock control valve 102 or an electric solenoid actuated unlock control valve 104; however, for purposes of clarity, only the front hydraulic cylinder 66 is shown in FIG. 5. When pressurized hydraulic fluid is provided to the unlock control valve 104 or the lock control valve 102, the actuation thereof will cause the retraction of deployment, respectively, of the supporting legs 14. In particular, when the lock control valve 102 is actuated, hydraulic fluid is provided from hydraulic pump 80 or manual pump 82 to the barrel ends of rear hydraulic cylinders 42 and front hydraulic cylinder 66 in order to cause their respective legs, 34 and 58, to be deployed. Similarly, when pressurized hydraulic fluid is provided to the unlock control valve 104, the hydraulic cylinders 42 and 66 are retracted thereby causing the retraction of their respective supporting legs 34 and 58.

The actuation of the solenoids of lock and unlock control valves 102 and 104, respectively, is electrically controlled. Lock control valve 102 is connected to a source of electric potential 106 through a switch 108 while unlock control valve 104 is connected to the source 106 through a switch 110. Electric potential source 106 preferably comprises house electrical power. However, in the event such is unavailable, electrical power may be provided to switches 108 and 110 by means of batteries 112 mounted on frame member 24.

In the operation of the present invention in the event house electrical power is available, the lock and unlock control valves 102 and 104, respectively, and the electric motor 78 are powered thereby. In such event, motor 78 causes the rotation of powered pump 80 to create pressurized hydraulic fluid. In the event house electrical power is unavailable, the batteries 112 provide the required electrical power to control lock and unlock control valves 102 and 104, respectively. In either event, the actuation of lock switch 108 causes the electric solenoid coupled to lock control valve 102 to provide pressurized hydraulic fluid to the barrel ends of rear hydraulic cylinders 42 and front hydraulic cylinder 66 to cause the rear and front leg members, 34 and 58, respectively, to be extended. Further, the actuation of unlock switch 110 causes pressurized hydraulic fluid to be supplied to the rod ends of rear hydraulic cylinders 42 and front hydraulic cylinder 66 to cause the rear and front leg members, 34 and 58, respectively, to be retracted.

In accordance with the present invention, therefore, in the event that the hydraulic motor 78 is disabled, hydraulic pressure for the application or release of the supporting legs 14 is provided by the manual pump 82. In the normal operation of the present invention, the hydraulic pressure is provided by means of hydraulic pump 80 which is driven by electric motor 78. However, in the event that electrical power is unavailable, manual pump 82 may be employed to raise or lower the supporting legs 14. Due to the mechanical configuration of the rear and front floor locking assemblies 30 and 52, respectively, the manual effort required is minimized to a completely acceptable level.

It will be appreciated that various changes in the details, materials and arrangements of parts which have been herein described and illustrated to explain the nature of invention may be made by those skilled in the art within the principle and scope of the invention as expressed in the appended claims.

What is claimed is:

1. Apparatus for supporting a carrier in a fixed location, said carrier having a base member and supporting wheels connected to said base member, comprising:

a. at least one vertical leg connected to said base member, said at least one leg being movable in a vertical direction from a retracted position in which said leg is not in contact with the ground to an extended position in which said leg is in contact with the ground and is effective to support at least a portion of the weight of said wheeled carrier;

b. a first link pivotally attached at one end to the upper portion of said at least one leg;

c. a second link pivotally attached at one end to said base member;

d. a hydraulic cylinder attached to said base member, said hydraulic cylinder having a piston rod the end of which is pivotally attached at a pivot point to the other ends of said first and said second links such that said piston rod is displaceable between a first position in which said first and second links cause said leg to be in its retracted position and a second position in which said first and said second links cause said leg to be in its extended position; and e. means for supplying hydraulic fluid under pressure to said hydraulic cylinder for moving said piston rod between its said first and second positions.

2. The apparatus of claim 1 in which said means for supplying hydraulic fluid comprises:

a. a first valve means for supplying hydraulic fluid to the rod end of said hydraulic cylinder to move said piston rod to its first position;

b. a second valve means for supplying hydraulic fluid to the barrel end of said hydraulic cylinder to move said piston rod to its second position; and c. a source of pressurized hydraulic fluid connected to said first and second valve means.

3. The apparatus of claim 2 in which said source of pressurized hydraulic fluid comprises:

a. an electric motor; and b. a hydraulic pump powered by said electric motor.

4. The apparatus of claim 2 in which said source of hydraulic fluid comprises a manually actuated hydraulic pump.

5. The apparatus of claim 4 in which said manually actuated hydraulic pump may be actuated by the foot of an operator.

6. The apparatus of claim 2 in which:

a. said first valve means comprises:

(1) a first electrically actuated solenoid valve coupled between said source of pressurized hydraulic fluid and the rod end of said hydraulic cylinder, said first solenoid valve being displaceable between its normally biased primary position in which said first solenoid valve prohibits the supply of pressurized hydraulic fluid to said rod end of said hydraulic cylinder and a secondary position in which said first solenoid valve allows the supply of hydraulic fluid to said rod end of said hydraulic cylinder; and (2) a first switch means coupled to a source of electric potential for controlling the displacement of said first solenoid valve to its secondary position; and b. said second valve means comprises:

(1) a second electrically actuated solenoid valve coupled between said source of pressurized hydraulic fluid and the barrel end of said hydraulic cylinder, said second solenoid valve being displaceable between its normally biased primary position in which said second solenoids valve prohibits the supply of pressurized hydraulic fluid to said barrel end of said hydraulic cylinder and a secondary position in which said second solenoid valve allows the supply of pressurized hydraulic fluid to said barrel end of said hydraulic cylinder; and (2) a second switch means coupled to a source of electric potential for controlling the displacement of said second solenoid valve to its secondary position.

7. The apparatus of claim 6 in which said source of electric potential comprises battery means.

8. Apparatus for supporting a carrier in a fixed location, said carrier having a base member and supporting wheels connected to said base member, comprising:

a. at least three vertical legs each connected to said base member, each said leg being movable in a vertical direction from a retracted position in which it is not in contact with the ground to an extended position in which it is in contact with the ground and is effective to support at least a portion of the weight of said wheeled carrier;

b. a plurality of first links with one first link being provided corresponding to each said leg, each first link being pivotally attached at one end to the upper portion of its corresponding leg;

c. a plurality of second links with one second link being provided corresponding to each said leg, each second link being pivotally attached at one end to said base member;

d. a plurality of hydraulic cylinders attached to said base member, each said hydraulic corresponding to one said leg, each hydraulic cylinder having a piston rod the end of which is pivotally attached to the other ends of the corresponding first and said second links, such that the said piston rods of each hydraulic cylinder are displaceable between a first position in which the corresponding said first and second second links cause the corresponding leg to be in its said retracted position and a second position in which each said first and said second links cause their corresponding legs to be in its extended position; and e. means for supplying hydraulic fluid under pressure to said hydraulic cylinders for moving said piston rods between their said first and second positions.

9. The apparatus of claim 8 in which said means for supplying hydraulic fluid comprises:

a. a first valve means for supplying hydraulic fluid to the rod ends of said hydraulic cylinders to move said piston rods to their first positions;

b. a second valve means for supplying hydraulic fluid to the barrel ends of said hydraulic cylinders to move said piston rods to their second positions; and c. a source of pressurized hydraulic fluid connected to said first and second valve means.

10. The apparatus of claim 9 in which said source of pressurized hydraulic fluid comprises:

a. an electric motor; and b. a hydraulic pump powered by said electric motor.

11. The apparatus of claim 9 in which said source of hydraulic fluid comprises a manually actuated hydraulic pump.

12. The apparatus of claim 11 in which said manually actuated hydraulic pump is actuated by the foot of an operator.

13. The apparatus of claim 9 in which:

a. said first valve means comprises:

(1) a first electrically actuated solenoid valve coupled between said source of pressurized hydraulic fluid and the rod ends of said hydraulic cylinders, said first solenoid valve being displaceable between its normally biased primary position in which said first solenoid valve prohibits the supply of pressurized hydraulic fluid to said rod ends of said hydraulic cylinders and a secondary position in which said first solenoid valve allows the supply pressurized hydraulic fluid to said rod ends of said hydraulic cylinders; and (2) a first switch means coupled to a source of electric potential for controlling the displacement of said first solenoid valve to its secondary position; and b. said second valve means comprises:

(1) a second electrically actuated solenoid valve coupled between said source of pressurized hydraulic fluid and the barrel ends of said hydraulic cylinders, said second solenoid valve being displaceable between its normally biased primary position in which said second solenoid valve prohibits the supply of pressurized hydraulic fluid to said barrel ends of said hydraulic cylinders and a secondary position in which said second solenoid valve allows the supply of pressurized hydraulic fluid to said barrel ends of said hydraulic cylinders; and (2) a second switch means coupled to a source of electric potential for controlling the displacement of said second solenoid valve to its secondary position.

14. The apparatus of claim 13 in which said source of electric potential comprises battery means.

* * * * *

UNITED STATES PATENT AND TRADEMARK OFFICE

CERTIFICATE OF CORRECTION

PATENT NO. : 4,833,972

DATED : May 30, 1989

INVENTOR(S) : Glen O. Bohusch, George D. Hall and Edward M. Shostek

It is certified that error appears in the above-identified patent and that said Letters Patent is hereby corrected as shown below:

Col. 4, line 68, delete "fon" and substitute therefor --for--.

Col. 7, line 59, delete "second" first occurrence and substitute therefor --said--.

Signed and Sealed this

Tenth Day of April, 1990

*Attest:*

HARRY F. MANBECK, JR.

*Attesting Officer*

*Commissioner of Patents and Trademarks*